US010683759B2

(12) United States Patent
Zemitis et al.

(10) Patent No.: US 10,683,759 B2
(45) Date of Patent: Jun. 16, 2020

(54) EDGE PROFILES FOR TIP SHROUDS OF TURBINE ROTOR BLADES

(71) Applicant: General Electric Company, Schenectady, NY (US)

(72) Inventors: William Scott Zemitis, Simpsonville, SC (US); Jacob Charles Perry, II, Taylors, SC (US); Melbourne James Myers, Woodruff, SC (US); Ajay Gangadhar Patil, Greer, SC (US); Richard Ryan Pilson, Greer, SC (US)

(73) Assignee: General Electric Company, Schenectady, NY (US)

( * ) Notice: Subject to any disclaimer, the term of this patent is extended or adjusted under 35 U.S.C. 154(b) by 116 days.

(21) Appl. No.: 15/933,582

(22) Filed: Mar. 23, 2018

(65) Prior Publication Data

US 2019/0292914 A1 Sep. 26, 2019

(51) Int. Cl.
*F01D 5/14* (2006.01)
*F01D 5/22* (2006.01)

(52) U.S. Cl.
CPC ..... *F01D 5/143* (2013.01); *F01D 5/225* (2013.01); *F05D 2240/307* (2013.01); *F05D 2250/74* (2013.01)

(58) Field of Classification Search
None
See application file for complete search history.

(56) References Cited

U.S. PATENT DOCUMENTS

| | | | | |
|---|---|---|---|---|
| 7,762,779 | B2 | 7/2010 | Zemitis et al. | |
| 7,887,295 | B2 * | 2/2011 | Brittingham | F01D 5/141 416/189 |
| 8,043,061 | B2 * | 10/2011 | Chiurato | F01D 5/225 416/189 |
| 8,057,186 | B2 * | 11/2011 | Brittingham | F01D 5/225 416/189 |
| 9,828,858 | B2 * | 11/2017 | Munoz | F01D 5/141 |

* cited by examiner

*Primary Examiner* — Christopher Verdier
*Assistant Examiner* — Juan G Flores
(74) *Attorney, Agent, or Firm* — Charlotte C. Wilson; James W. Pemrick

(57) ABSTRACT

A turbine rotor blade including an airfoil having a tip shroud, the tip shroud having leading and trailing edges, the leading edge having a leading edge profile including first and second scalloped sections substantially in accordance with X and Y coordinate values in a Cartesian coordinate system at points 1-6 and 11-25, respectively, as set forth in Table I, where X and Y are distances in inches from an origin and, when points 1-6 and points 11-25 are connected by smooth, continuing arcs, the points define the first and second scalloped sections, respectively, of the leading edge profile of the tip shroud.

19 Claims, 3 Drawing Sheets

EDGE PROFILES FOR TIP SHROUDS OF TURBINE ROTOR BLADES

BACKGROUND OF THE INVENTION

The present invention relates to turbine rotor blades having an airfoil and a tip shroud carried by the airfoil. More particularly, but not by way of limitation, the present invention relates to edge profiles for tip shrouds of turbine rotor blades.

Turbine rotor blades typically comprise an airfoil, a platform, a shank and dovetail. Oftentimes, the airfoil also includes an integrally formed tip shroud mounted at a tip of the airfoil, which is supported by a fillet formed therebetween. Because rotor blades operate at such high rotational velocities and reside in the hot gas path, they are generally subjected to extreme thermal and mechanical loads. In the case of the tip shroud, however, because it is positioned at the outer tip of the airfoil and extends beyond the airfoil so to overhang it, the resulting mechanical stresses are magnified and concentrated in the supporting fillet, which makes the size, shape, and overall mass of the tip shroud a critical design consideration. Tip shrouds, though, require a certain size and coverage to perform adequately as a seal. In general, such competing mechanical and aerodynamic considerations, make the design of tip shrouds a challenging problem, One significant component of this design is the profile of the tip shroud. As will be seen, tip shroud profile is the size of the tip shroud—i.e., the extent to which it extends beyond and overhangs the airfoil—as well as the shape of the tip shroud—i.e., the nature of the contoured edges that define the shape of the tip shroud. To be successful, a tip shroud profile must offer size and coverage so to promote sealing functionality, while maintaining an overall mass that can be mechanically supported by a fillet that does not overly compromise aerodynamic performance. Further, tip shroud profiles having even small mass imbalances can result in a significant difference between the stresses within the pressure and suction sides of the fillet region, which can negatively impact the creep life of the blade. Tip shroud profiles, thus, must be precisely tuned to offer enough coverage for achieving a high-level of sealing performance, while removing as much tip shroud mass as possible—and finely balancing the remainder—so that the tip shroud can be adequately supported by an aerodynamic fillet for a long creep life.

BRIEF DESCRIPTION OF THE INVENTION

The present application thus describes a turbine rotor blade including an airfoil having a tip shroud. The tip shroud may have leading and trailing edges. The leading edge may have a leading edge profile including first and second scalloped sections substantially in accordance with X and Y coordinate values in a Cartesian coordinate system at points 1-6 and 11-25, respectively, as set forth in Table I, where X and Y are distances in inches from an origin and, when points 1-6 and points 11-25 are connected by smooth, continuing arcs, the points define the first and second scalloped sections, respectively, of the leading edge profile of the tip shroud.

The present application further describes a turbine rotor blade including a rotor blade airfoil having a tip shroud. The tip shroud may have leading and trailing edges. The trailing edge may have a trailing edge profile substantially in accordance with X and Y coordinate values in a Cartesian coordinate system at points 47-68, as set forth in Table I, where X and Y are distances in inches from an origin and, when points 47-68 are connected by smooth, continuing arcs, the points define the trailing edge profile of the tip shroud.

The present application further describes a turbine rotor blade including a rotor blade airfoil having a tip shroud. The tip shroud may have leading and trailing edges and first and second Z-form edges. The first Z-form edge may have a first Z-form edge profile substantially in accordance with X and Y coordinate values in a Cartesian coordinate system at points 69-82, as set forth in Table I, where X and Y are distances in inches from an origin and, when points 69-82 are connected by smooth, continuing arcs or lines, the points define the first Z-form edge profile.

The present application further describes a turbine rotor blade including a rotor blade airfoil having a tip shroud. The tip shroud has leading and trailing edges and first and second Z-form edges. The second Z-form edge has a second Z-form edge profile substantially in accordance with X and Y coordinate values in a Cartesian coordinate system at points 26-46, as set forth in Table I, where X and Y are distances in inches from an origin and, when points 26-46 are connected by smooth, continuing arcs or lines, the points define the second Z-form edge profile.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
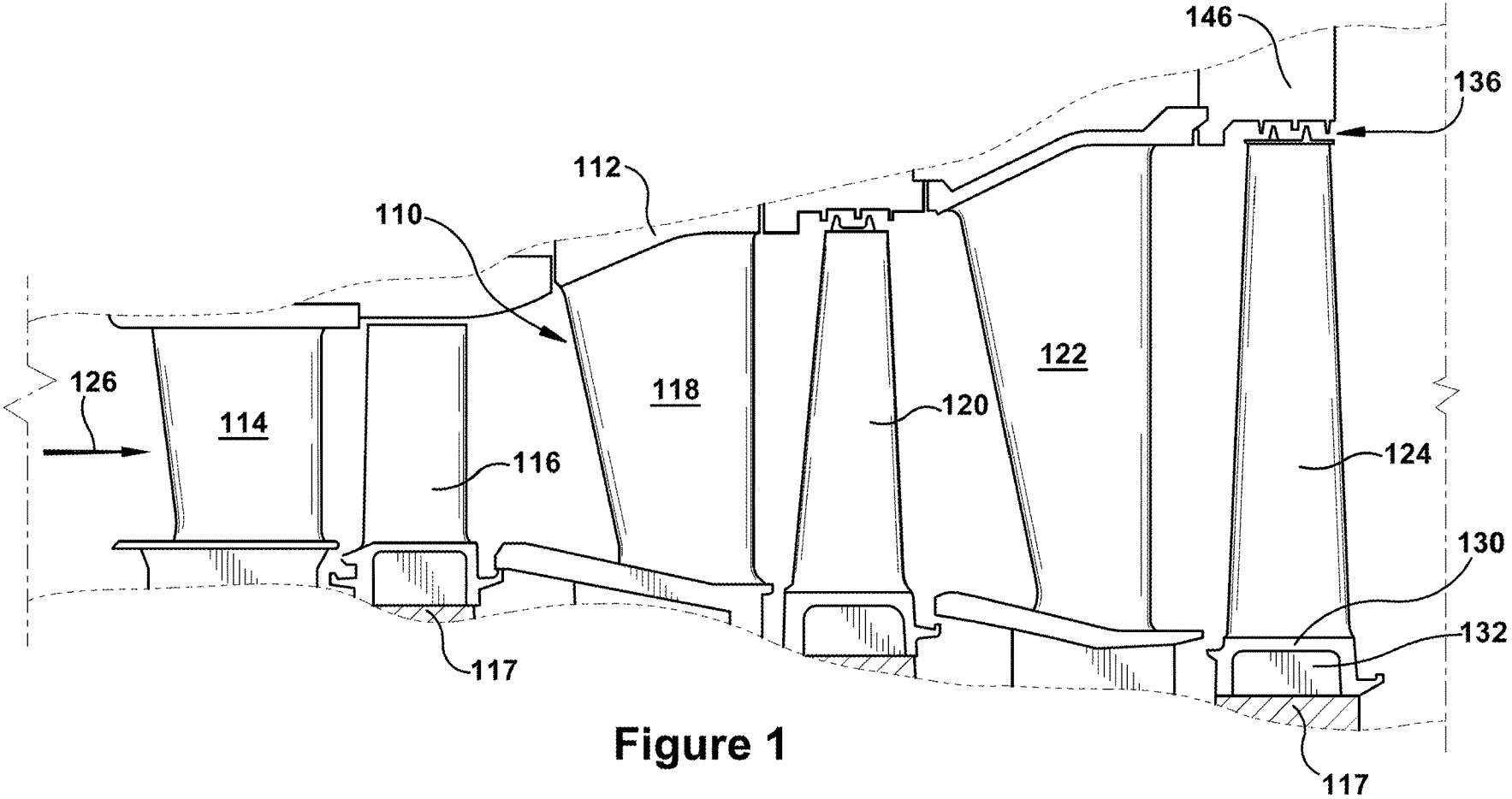
FIG. 1 is a schematic illustration of a turbine section having a third stage turbine rotor blade tip shroud with predetermined leading and trailing edge profiles according to a preferred embodiment of the present invention.

Referring now to the drawing figures, particularly to FIG. 1, there is illustrated a hot gas path, generally designated 110, of a gas turbine 112 including a plurality of turbine stages. Three stages are illustrated. For example, the first stage comprises a plurality of circumferentially spaced stator blades 114 and rotor blades 116. The stator blades are circumferentially spaced one from the other and fixed about the axis of the rotor. The first stage rotor blades 116, of course, are mounted on the turbine rotor wheel 117. A second stage of the turbine 112 is also illustrated, including a plurality of circumferentially spaced stator blades 118 and a plurality of circumferentially spaced rotor blades 120 mounted on the rotor. The third stage is also illustrated including a plurality of circumferentially spaced stator blades 122 and rotor blades 124 mounted on the rotor 117. It will be appreciated that the stator blades and rotor blades lie in the hot gas path 110 of the turbine 112, the direction of flow of the hot gas through the hot gas path 110 being indicated by the arrow 126.

Rotor blades 116,120,124 are provided with a platform 130, a shank 132 and a dovetail, not shown, for connection with a complementary-shaped mating dovetail, also not shown, on a rotor wheel forming part of the rotor. Rotor blades 116,120,124 also include an airfoil 134, having an airfoil profile at any cross-section along the airfoil from the platform to the airfoil tip, as illustrated by the dashed lines in FIGS. 2 and 3. A tip shroud 136 may be provided at the airfoil tip, for example, as shown on rotor blades 124.

Figure 2:
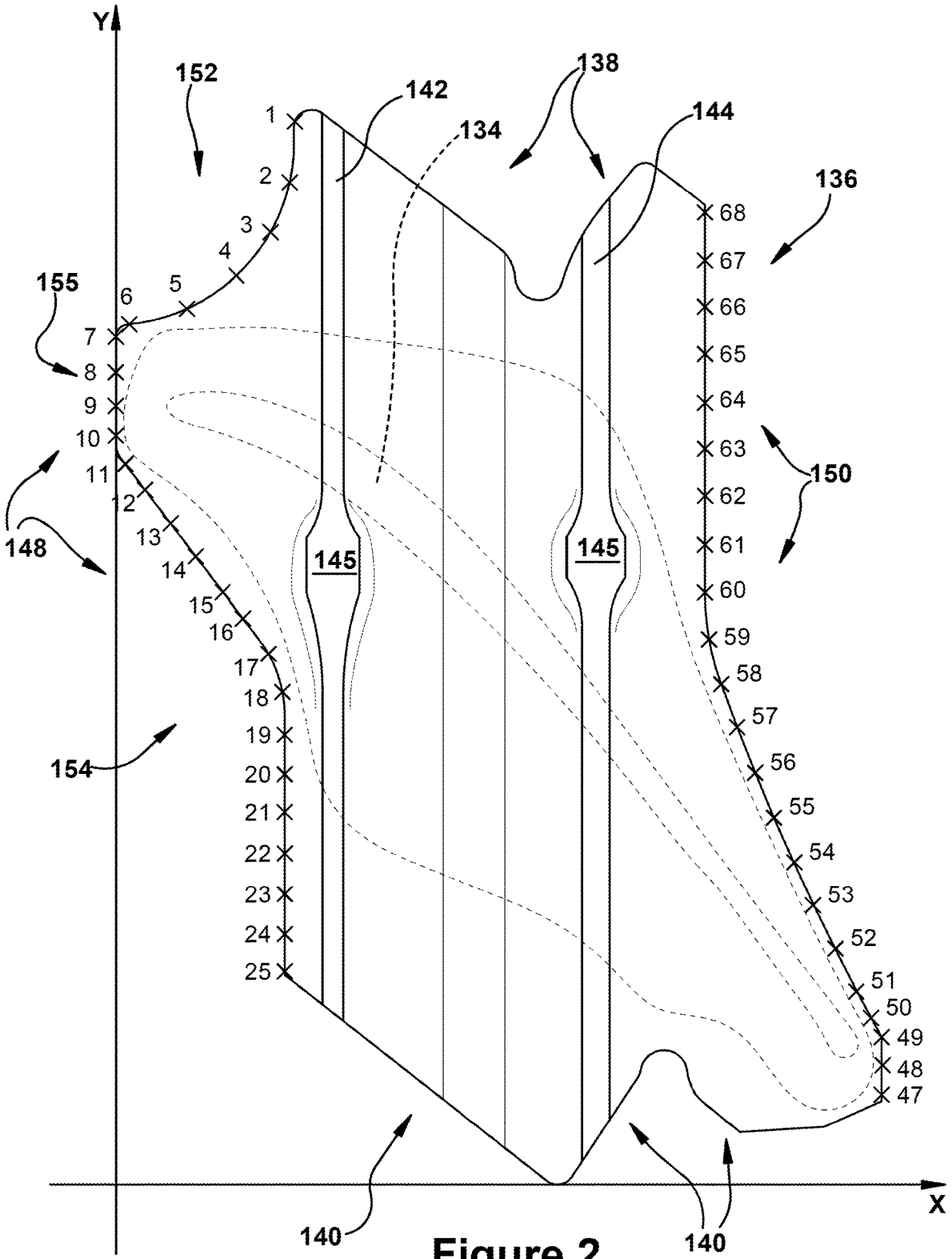
FIG. 2 is an enlarged end view of a tip shroud embodying the invention as viewed looking radially inwardly and illustrating the location of the points related to the leading and trailing edges of the tip shroud, the positions of which are set forth in Table I.
Figure 3:
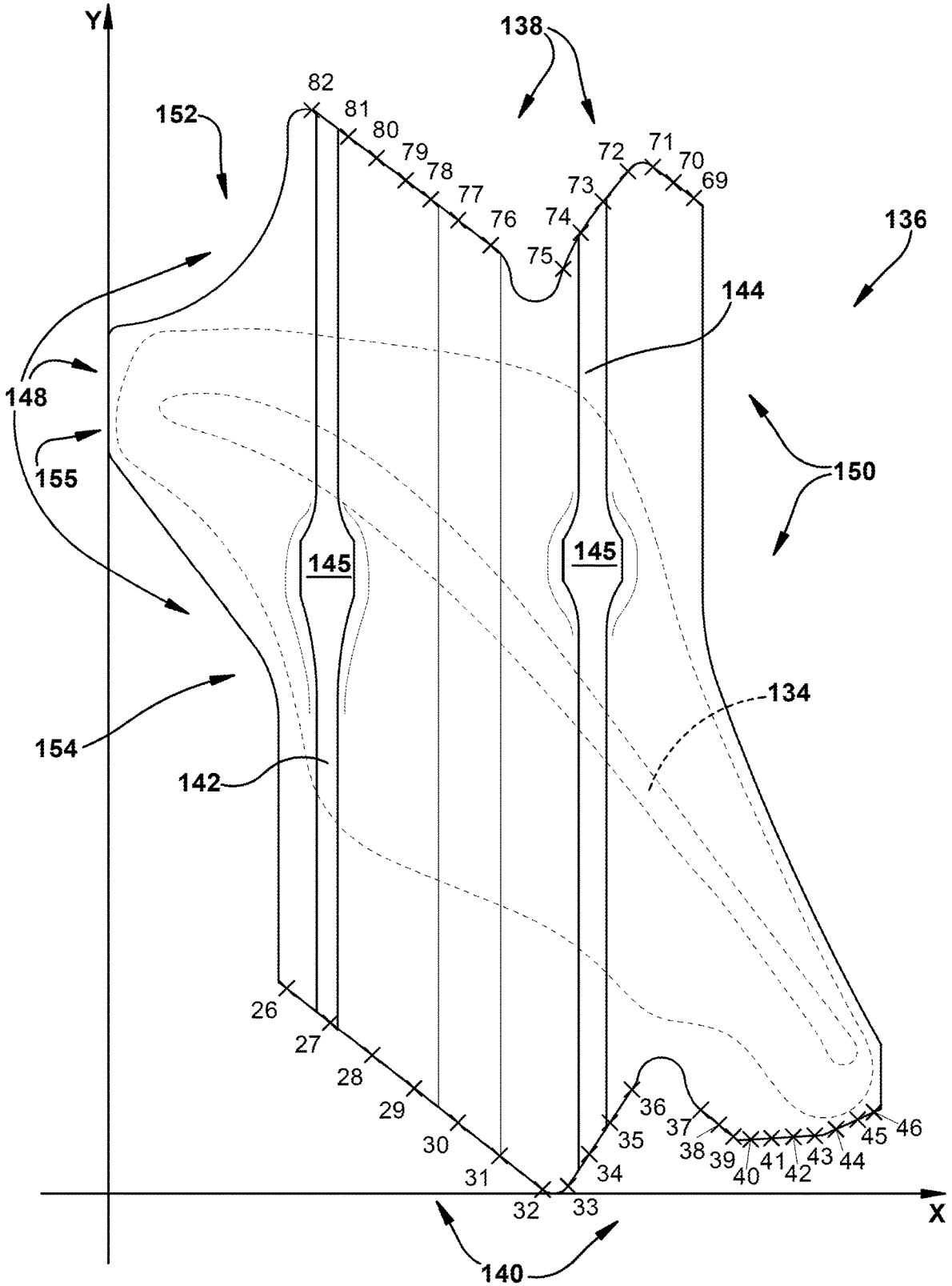
FIG. 3 is an enlarged end view of a tip shroud embodying the invention as viewed looking radially inwardly and illustrating the location of the points related to the first and second Z-form edges of the tip shroud, the positions of which are set forth in Table I.

FIGS. 2 and 3 illustrate a profile of a tip shroud 136 pursuant to an embodiment of the present invention. As will be appreciated, tip shrouds 136 are preferably formed integrally with the rotor blades. The profile of the tip shroud 136 is defined by several outer edges that will now be described. For instance, the tip shroud 136 includes circumferentially opposite contact or Z-form edges 138, 140, respectively, with the first Z-form edge 138 rotationally leading the second Z-form edge 140 relative to the rotation of the rotor blade during operation. It should be understood that the "Z-form" refers to the general "Z" shape of these contact surfaces, but is not intended to be limiting. The first and second Z-form edges 138,140 of the tip shroud 136 engage with the corresponding Z-form edges of the tip shrouds of adjacent rotor blades, and, in this way, form an annular ring or shroud circumscribing the hot gas path. As also illustrated, the tip shroud 136 includes shaped leading and trailing edges 148 and 150, respectively, with the leading edge 148 residing upstream of the trailing edge 150 given the direction of flow of working fluid through the hot gas path. Thus, generally, the leading edge 148 overhangs a leading edge of the airfoil 134, and the trailing edge 150 overhangs the trailing edge of the airfoil 134. As will be appreciated, the leading and trailing edges 148,150 lie on opposite axially facing sides of the tip shroud 136 in the hot gas path. According the embodiments of the present invention, the shaped leading edge 148 may have two scalloped sections, which may be differentiated as a first scallop section 152 and second scalloped section 154. A connection section 155 may be positioned between the first scallop section 152 and second scalloped section 154. The trailing edge 150 may shaped according to a single scallop.

As also illustrated in FIGS. 2 and 3, the tip shroud 136 may include forward and aftward seal rails 142,144 along its radial outer surface. As will be appreciated, the seal rails 142,144 form continuous, circumferentially extending seal rings about the tip shrouds within the stage of rotor blades for sealing with a stationary shroud 46 (see FIG. 1) fixed to the turbine casing. The illustrated seal rails 142,144 each further includes a cutter tooth 145.

As will be appreciated, given the radially inward perspective of FIG. 2, the general shape of the profile of the tip shroud 136 of the present invention is illustrated. To more particularly define the tip shroud profile of the present invention, a unique set or loci of points in space will be provided. It should be understood that these points are defined in relation to a Cartesian coordinate system of X and Y axes, which is schematically depicted on FIG. 2. FIG. 2 further indicates the general location of representative points that may be used to define the tip shroud profile along the leading edge 148 (also "leading edge profile") and trailing edge 150 (also "trailing edge profile") of the tip shroud 136. Each of those representative points shown on FIG. 2 is numbered, with the position of each being identifiable in Table I per that numeral identifier. Thus, as will be appreciated, X and Y coordinate values for those points, which are labeled in FIG. 2 for the leading edge 148 (and scalloped sections 152,154 and the connecting section 155 included therein) and trailing edge section 150 are given in Table I below. In this way, the profile of the leading edge 148 and trailing edge 150 is defined at various representative locations, and those locations may be used to define the shape of the profile of the leading and trailing edges 148,150, as well as profiles of particular scalloped sections contained therein, of the tip shroud 36.

The values for the X and Y coordinates are set forth in inches in Table I, although other units of dimensions may be used when the values are appropriately converted. It should be understood that, by defining X and Y coordinate values at selected locations relative to the origin of the X and Y axes of FIG. 2, the locations of the points, which are numbered 1 through 25 and 47 through 68, can be ascertained. By connecting those ascertained points of the X and Y values with smooth, continuing arcs along each of the several edges as so defined, each edge profile, in whole or in part, can be ascertained.

FIG. 3 also illustrates the general shape of the profile of the tip shroud 136 of the present invention is illustrated. To more particularly define the other aspects of the tip shroud profile of the present invention, a unique set or loci of points in space will be provided. It should be understood that these points are defined in relation to a Cartesian coordinate system of X and Y axes, which is schematically depicted on FIG. 3. FIG. 3 further indicates the general location of representative points that may be used to define the tip shroud profile along the first Z-form edge 138 (also "first Z-form edge profile") and the second Z-form edge 140 (also "second Z-form edge profile") of the tip shroud 136. Each of the representative points shown on FIG. 3 is numbered, with the position of each being identifiable in Table I per that numeral identifier. Thus, as will be appreciated, X and Y values for those points, which are labeled in FIG. 3 for the first and second Z-form edges 138,140, are given in Table I below. In this way, the profile of first Z-form edge 138 and second Z-form edge 140 is defined at various representative locations, and those locations may be used to define the overall shape or profile of the first and second Z-form edges 138,140, as well as segments contained therein, of the tip shroud 36.

The values for the X and Y coordinates are set forth in inches in Table I, although other units of dimensions may be used when the values are appropriately converted. It should be understood that, by defining X and Y coordinate values at selected locations relative to the origin of the X and Y axes of FIG. 3, the locations of the points, which are numbered 26 through 46 and 69 through 82, can be ascertained. By connecting those ascertained points of the X and Y values with smooth, continuing arcs along each of the several edges as so defined, each edge profile, in whole or in part, can be ascertained.

TABLE 1

| Point | X | Y |
|---|---|---|
| 1 | 0.6842 | 4.3357 |
| 2 | 0.6712 | 4.1047 |
| 3 | 0.6057 | 3.8841 |
| 4 | 0.4613 | 3.7058 |
| 5 | 0.2682 | 3.5801 |
| 6 | 0.0483 | 3.5093 |
| 7 | 0.0000 | 3.4504 |
| 8 | 0.0000 | 3.3145 |

TABLE 1-continued

| Point | X | Y |
|---|---|---|
| 9 | 0.0000 | 3.1786 |
| 10 | 0.0000 | 3.0427 |
| 11 | 0.0231 | 2.9703 |
| 12 | 0.1186 | 2.8361 |
| 13 | 0.2140 | 2.7019 |
| 14 | 0.3094 | 2.5678 |
| 15 | 0.4047 | 2.4339 |
| 16 | 0.4997 | 2.3004 |
| 17 | 0.5819 | 2.1592 |
| 18 | 0.6319 | 2.0031 |
| 19 | 0.6469 | 1.8394 |
| 20 | 0.6469 | 1.6748 |
| 21 | 0.6469 | 1.5103 |
| 22 | 0.6469 | 1.3459 |
| 23 | 0.6469 | 1.1818 |
| 24 | 0.6469 | 1.0179 |
| 25 | 0.6469 | 0.8542 |
| 26 | 0.6686 | 0.8080 |
| 27 | 0.8341 | 0.6713 |
| 28 | 0.9976 | 0.5362 |
| 29 | 1.1594 | 0.4026 |
| 30 | 1.3202 | 0.2697 |
| 31 | 1.4819 | 0.1361 |
| 32 | 1.6467 | 0.0000 |
| 33 | 1.7360 | 0.0149 |
| 34 | 1.8153 | 0.1440 |
| 35 | 1.8947 | 0.2731 |
| 36 | 1.9740 | 0.4023 |
| 37 | 2.2670 | 0.2981 |
| 38 | 2.3205 | 0.2539 |
| 39 | 2.3740 | 0.2097 |
| 40 | 2.4174 | 0.1962 |
| 41 | 2.5123 | 0.2045 |
| 42 | 2.6071 | 0.2128 |
| 43 | 2.7020 | 0.2211 |
| 44 | 2.7227 | 0.2268 |
| 45 | 2.8049 | 0.2663 |
| 46 | 2.8870 | 0.3058 |
| 47 | 2.9210 | 0.3599 |
| 48 | 2.9210 | 0.4547 |
| 49 | 2.9210 | 0.5495 |
| 50 | 2.9081 | 0.6047 |
| 51 | 2.8234 | 0.7796 |
| 52 | 2.7411 | 0.9557 |
| 53 | 2.6621 | 1.1332 |
| 54 | 2.5866 | 1.3124 |
| 55 | 2.5139 | 1.4926 |
| 56 | 2.4426 | 1.6734 |
| 57 | 2.3711 | 1.8541 |
| 58 | 2.3046 | 2.0367 |
| 59 | 2.2577 | 2.2254 |
| 60 | 2.2442 | 2.4196 |
| 61 | 2.2442 | 2.6147 |
| 62 | 2.2442 | 2.8097 |
| 63 | 2.2442 | 3.0047 |
| 64 | 2.2442 | 3.1997 |
| 65 | 2.2442 | 3.3947 |
| 66 | 2.2442 | 3.5896 |
| 67 | 2.2442 | 3.7846 |
| 68 | 2.2442 | 3.9795 |
| 69 | 2.2158 | 4.0309 |
| 70 | 2.1371 | 4.0948 |
| 71 | 2.0584 | 4.1586 |
| 72 | 1.9691 | 4.1423 |
| 73 | 1.8898 | 4.0119 |
| 74 | 1.8105 | 3.8815 |
| 75 | 1.7312 | 3.7511 |
| 76 | 1.4383 | 3.8505 |
| 77 | 1.3289 | 3.9391 |
| 78 | 1.2195 | 4.0276 |
| 79 | 1.1102 | 4.1161 |
| 80 | 1.0009 | 4.2046 |
| 81 | 0.8917 | 4.2930 |
| 82 | 0.7825 | 4.3813 |

It will be appreciated that the preceding values of Table 1 represent edge profiles for tip shrouds at ambient, non-operating or non-hot conditions, i.e., cold conditions. Further, it will be appreciated that there are typical manufacturing tolerances, as well as coatings, which must be accounted for in the actual profiles of the tip shroud edges. Accordingly, the values for the tip shroud profile given in Table I are for a nominal tip shroud. It will therefore be appreciated that +/− typical manufacturing tolerances, i.e., +/− values, including any coating thicknesses, are additive to the X, Y values given in Table I above. Accordingly, a distance of +/−0.080 inches in a direction normal to any surface location along the leading and trailing edges and Z-form edges defines a tip shroud edge profile envelope along the respective leading and trailing edges and Z-form edges for this particular tip shroud design, i.e., a range of variation between measured points on the actual edge profiles at a nominal cold or room temperature and the ideal position of those edge profiles as given in the Table I above at the same temperature. The tip shroud design is robust to this range of variation without impairment of mechanical and aerodynamic function and is embraced by the profiles substantially in accordance with the Cartesian coordinate values of the points 1 through 82 as set forth in Table I.

As should be understood, a significant component of tip shroud design is profile. Tip shroud profile includes the size of the tip shroud—i.e., the extent to which it extends beyond and overhangs the airfoil—as well as the shape of the tip shroud—i.e., the nature of the contoured edges that define the shape of the tip shroud. To be successful, a tip shroud profile must offer size and coverage so to promote sealing functionality, while maintaining an overall mass that can be mechanically supported by a fillet that does not overly compromise aerodynamic performance. Further, tip shroud profiles having even small mass imbalances can result in a significant difference between the stresses within the pressure and suction sides of the fillet region, which can negatively impact the creep life of the blade. The tip shroud profiles represented in Table 1 is precisely configured to offer enough coverage for achieving a high-level of sealing performance, while removing as much tip shroud mass as possible—and finely balancing the remainder—so that the tip shroud can be adequately supported by an aerodynamic fillet for a long creep life. That is, the tip shroud profiles defined herein offer unique performance characteristics, including the removal of material in strategic locations to enhance creep life performance of the supporting fillet, while maintaining adequate coverage for high-level seal performance. Additionally, the tip shroud profiles of the current invention work in tandem with certain fillet designs for effectively balancing pressure side and suction side stresses that can significantly prolong component life. For example, testing has shown that, when coupled with such fillet designs, creep life has been extended up to 5-times compared to the competing tip shroud/fillet designs currently in use.

Further, while the current fillet profile, as described, is proved effective to particular rotor blade designs, it is scaleable to similar usage with other rotor blade sizes. That is, the tip shrouds disclosed in Table I may be scaled up or down geometrically for use in other similar turbine blade designs. Consequently, the coordinate values set forth in Table I may be scaled upwardly or downwardly such that the tip shroud leading and trailing edges and the first and second Z-form edges remain unchanged. For example, a scaled version of the coordinates of Table I would be represented by X and Y coordinate values of Table I multiplied or divided by the same number.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, each of the possible iterations is not provided or discussed in detail, though all combinations and possible embodiments embraced by the several claims below or otherwise are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

That which is claimed:

1. A turbine rotor blade including an airfoil having a tip shroud, the tip shroud having leading and trailing edges, the leading edge having a leading edge profile including first and second scalloped sections substantially in accordance with X and Y coordinate values in a Cartesian coordinate system at points 1-6 and 11-25, respectively, as set forth in Table I, where X and Y are distances in inches from an origin and, when points 1-6 and points 11-25 are connected by smooth, continuing arcs, the points define the first and second scalloped sections, respectively, of the leading edge profile of the tip shroud.

2. The turbine rotor blade according to claim 1, wherein the leading edge profile comprises a connecting section positioned between the first and second scalloped sections substantially in accordance with X and Y coordinate values in the Cartesian coordinate system at points 7-10, as set forth in Table I, where X and Y are distances in inches from the origin and, when points 7-10 are connected by smooth, continuing arcs, the points define the connecting section of the leading edge profile of the tip shroud.

3. The turbine rotor blade according to claim 1, wherein the leading edge profile lies in an envelope within +/−0.080 inches in a direction normal to any location along the leading edge profile.

4. The turbine rotor blade according to claim 1, wherein the X and Y coordinate values set forth in Table I are scalable as a function of a common number to provide a scaled-up or scaled-down leading edge profile.

5. The turbine rotor blade according to claim 1, wherein the tip shroud further comprises first and second Z-form edges, the first and second Z-form edges comprising a first Z-form edge profile and a second Z-form edge profile substantially in accordance with X and Y coordinate values in the Cartesian coordinate system at points 26-46 and 69-82, respectively, as set forth in Table I, where X and Y are distances in inches from the origin and, when points 26-46 and points 69-82 are connected by smooth, continuing arcs or lines, the points define the first Z-form edge and second Z-form edge profiles, respectively, of the tip shroud.

6. The turbine rotor blade according to claim 5, wherein the tip shroud further comprises circumferentially extending leading and trailing seal rails that each extends between the first Z-form edge and the second Z-form edge.

7. A turbine rotor blade including a rotor blade airfoil having a tip shroud, the tip shroud having leading and trailing edges, wherein the trailing edge comprises a trailing edge profile substantially in accordance with X and Y coordinate values in a Cartesian coordinate system at points 47-68, as set forth in Table I, where X and Y are distances in inches from an origin and, when points 47-68 are connected by smooth, continuing arcs, the points define the trailing edge profile of the tip shroud.

8. The turbine rotor blade according to claim 7, wherein the trailing edge profile lies in an envelope within +/−0.080 inches in a direction normal to any location along the trailing edge profile.

9. The turbine rotor blade according to claim 7, wherein the X and Y coordinate values set forth in Table I are scalable as a function of a common number to provide a scaled-up or scaled-down trailing edge profile.

10. The turbine rotor blade according to claim 7, wherein the leading edge comprises a leading edge profile including first and second scalloped sections substantially in accordance with X and Y coordinate values in the Cartesian coordinate system at points 1-6 and 11-25, respectively, as set forth in Table I, where X and Y are distances in inches from the origin and, when points 1-6 and points 11-25 are connected by smooth, continuing arcs, the points define the first and second scalloped sections, respectively, of the leading edge profile of the tip shroud.

11. The turbine rotor blade according to claim 7, wherein the tip shroud further comprises first and second Z-form edges, the first and second Z-form edges comprising a first Z-form edge profile and a second Z-form edge profile substantially in accordance with X and Y coordinate values in the Cartesian coordinate system at points 26-46 and 69-82, respectively, as set forth in Table I, where X and Y are distances in inches from the origin and, when points 26-46 and points 69-82 are connected by smooth, continuing arcs or lines, the points define the first Z-form edge and second Z-form edge profiles, respectively, of the tip shroud.

12. The turbine rotor blade according to claim 11, wherein the tip shroud further comprises circumferentially extending leading and trailing seal rails that each extends between the first Z-form edge and the second Z-form edge.

13. A turbine rotor blade including a rotor blade airfoil having a tip shroud, the tip shroud having leading and trailing edges and first and second Z-form edges, the first Z-form edge having a first Z-form edge profile substantially in accordance with X and Y coordinate values in a Cartesian coordinate system at points 69-82, as set forth in Table I, where X and Y are distances in inches from an origin and, when points 69-82 are connected by smooth, continuing arcs or lines, the points define the first Z-form edge profile.

14. The turbine rotor blade according to claim 13, wherein the second Z-form edge comprises a second Z-form edge profile substantially in accordance with X and Y coordinate values in the Cartesian coordinate system at points 26-46, as set forth in Table I, where X and Y are distances in inches from the origin and, when points 26-46 are connected by smooth, continuing arcs or lines, the points define the second Z-form edge profile.

15. The turbine rotor blade according to claim 14, wherein the first Z-form edge profile lies in an envelope within +/−0.080 inches in a direction normal to any location along the first Z-form edge profile; and wherein the second Z-form edge profile lies in an envelope within +/−0.080 inches in a direction normal to any location along the second Z-form edge profile.

16. The turbine rotor blade according to claim 14, wherein the X and Y coordinate values set forth in Table I are scalable as a function of a common number to provide a scaled-up or scaled-down first Z-form edge profile and a second Z-form edge profile.

17. The turbine rotor blade according to claim 14, wherein the leading edge comprises a leading edge profile including first and second scalloped sections substantially in accordance with X and Y coordinate values in the Cartesian coordinate system at points 1-6 and 11-25, respectively, as set forth in Table I, where X and Y are distances in inches from the origin and, when points 1-6 and points 11-25 are connected by smooth, continuing arcs, the points define the first and second scalloped sections, respectively, of the leading edge profile of the tip shroud.

18. The turbine rotor blade according to claim 17, wherein the trailing edge comprises a trailing edge profile substantially in accordance with X and Y coordinate values in the Cartesian coordinate system at points 47-68, as set forth in Table I, where X and Y are distances in inches from the origin and, when points 47-68 are connected by smooth, continuing arcs, the points define the trailing edge profile of the tip shroud.

19. The turbine rotor blade according to claim 18, wherein the tip shroud further comprises circumferentially extending leading and trailing seal rails that each extends between the first Z-form edge and the second Z-form edge.

* * * * *